US010906298B2

(12) United States Patent
Cho

(10) Patent No.: US 10,906,298 B2
(45) Date of Patent: Feb. 2, 2021

(54) INKJET PRINTING APPARATUS

(71) Applicant: STI CO., LTD., Anseong-si (KR)

(72) Inventor: Yuhho Cho, Anseong-si (KR)

(73) Assignee: STI CO., LTD., Anseong-si (KR)

( * ) Notice: Subject to any disclaimer, the term of this patent is extended or adjusted under 35 U.S.C. 154(b) by 0 days.

(21) Appl. No.: 16/290,369

(22) Filed: Mar. 1, 2019

(65) Prior Publication Data

US 2020/0180307 A1 Jun. 11, 2020

(30) Foreign Application Priority Data

Dec. 10, 2018 (KR) ..... 10-2018-0158507

(51) Int. Cl.
*B41J 2/045* (2006.01)

(52) U.S. Cl.
CPC ..... *B41J 2/04535* (2013.01); *B41J 2/04586* (2013.01)

(58) Field of Classification Search
CPC ... B41J 2/0456; B41J 2/04535; B41J 2/04586
See application file for complete search history.

(56) References Cited

U.S. PATENT DOCUMENTS

2008/0259108 A1* 10/2008 Otsuka ..... B41J 2/04535 347/14
2008/0316280 A1* 12/2008 Yamada ..... B41J 2/1612 347/68
2011/0134175 A1* 6/2011 Hong ..... B41J 2/04506 347/10

FOREIGN PATENT DOCUMENTS

JP 2017064920 A * 4/2017

* cited by examiner

*Primary Examiner* — Bradley W Thies
(74) *Attorney, Agent, or Firm* — Novick, Kim & Lee, PLLC; Sang Ho Lee

(57) ABSTRACT

An inkjet printing apparatus is provided. The inkjet printing apparatus includes a plurality of nozzles, each of the plurality of nozzles adapted to be controlled to discharge a separated ink quantity mapped to a control value input, a nozzle performance measuring circuit inputting the control value mapped to the separated ink quantity to the each of the plurality of nozzles, and a control circuit calculating a target print ink quantity in case where a reference separated ink quantity is discharged from a plurality of dots on a window and determining the control value of each of the plurality of nozzles. The control circuit may designate one dot in the window as a reference dot and determine the control value of the each of the plurality of nozzles within the window as the reference dot and the window move sequentially within a printing area.

6 Claims, 20 Drawing Sheets

| | 1 | 2 | 3 | 4 | 5 | 6 | 7 | 8 | 9 |
|---|---|---|---|---|---|---|---|---|---|
| 1 | 0 | 0 | 0 | 0 | 0 | 0 | 0 | 0 | 0 |
| 2 | | | | | | | | | |
| 3 | | | | | | | | | |
| 4 | | | | | | | | | |
| 5 | | | | | | | | | |
| 6 | | | | | | | | | |

FIG. 4A

| | 1 | 2 | 3 | 4 | 5 | 6 | 7 | 8 | 9 |
|---|---|---|---|---|---|---|---|---|---|
| 1 | 4.97 | 5.06 | 4.98 | 5.02 | 5.00 | 5.02 | 5.05 | 4.98 | 5.01 |
| 2 | | | | | | | | | |
| 3 | | | | | | | | | |
| 4 | | | | | | | | | |
| 5 | | | | | | | | | |
| 6 | | | | | | | | | |

FIG. 4B

| | 1 | 2 | 3 | 4 | 5 | 6 | 7 | 8 | 9 |
|---|---|---|---|---|---|---|---|---|---|
| 1 | 0 | 0 | 0 | 0 | 0 | 0 | 0 | 0 | 0 |
| 2 | 1 | -1 | 1 | -1 | 0 | -1 | -1 | 1 | -1 |
| 3 | | | | | | | | | |
| 4 | | | | | | | | | |
| 5 | | | | | | | | | |
| 6 | | | | | | | | | |

FIG. 5A

| | 1 | 2 | 3 | 4 | 5 | 6 | 7 | 8 | 9 |
|---|---|---|---|---|---|---|---|---|---|
| 1 | 5.02 | 5.00 | 4.97 | 5.00 | 5.02 | 5.02 | 5.01 | 4.98 | 4.97 |
| 2 | 5.04 | 4.99 | 5.05 | 4.95 | 5.00 | 4.95 | 4.98 | 5.03 | 4.94 |
| 3 | | | | | | | | | |
| 4 | | | | | | | | | |
| 5 | | | | | | | | | |
| 6 | | | | | | | | | |

FIG. 5B

WD

| | 1 | 2 | 3 | 4 | 5 | 6 | 7 | 8 | 9 |
|---|---|---|---|---|---|---|---|---|---|
| 1 | 0 | 0 | 0 | 0 | 0 | 0 | 0 | 0 | 0 |
| 2 | 1 | -1 | 1 | -1 | 0 | -1 | -1 | 1 | -1 |
| 3 | 0 | 0 | | | | | | | |
| 4 | | | | | | | | | |
| 5 | | | | | | | | | |
| 6 | | | | | | | | | |

FIG. 6A

WD

| | 1 | 2 | 3 | 4 | 5 | 6 | 7 | 8 | 9 |
|---|---|---|---|---|---|---|---|---|---|
| 1 | 4.97 | 5.06 | 4.98 | 5.02 | 5.00 | 5.02 | 5.05 | 4.98 | 5.01 |
| 2 | 5.04 | 4.99 | 5.05 | 4.95 | 5.00 | 4.95 | 4.98 | 5.03 | 4.94 |
| 3 | 4.97 | 5.06 | | | | | | | |
| 4 | | | | | | | | | |
| 5 | | | | | | | | | |
| 6 | | | | | | | | | |

FIG. 6B

WD

| | 1 | 2 | 3 | 4 | 5 | 6 | 7 | 8 | 9 |
|---|---|---|---|---|---|---|---|---|---|
| 1 | 0 | 0 | 0 | 0 | 0 | 0 | 0 | 0 | 0 |
| 2 | -1 | 0 | 1 | 0 | -1 | -1 | -1 | 1 | 1 |
| 3 | 0 | 0 | -1 | | | | | | |
| 4 | | | | | | | | | |
| 5 | | | | | | | | | |
| 6 | | | | | | | | | |

FIG. 7A

WD

| | 1 | 2 | 3 | 4 | 5 | 6 | 7 | 8 | 9 |
|---|---|---|---|---|---|---|---|---|---|
| 1 | 4.97 | 5.06 | 4.98 | 5.02 | 5.00 | 5.02 | 5.05 | 4.98 | 5.01 |
| 2 | 5.04 | 4.99 | 5.05 | 4.95 | 5.00 | 4.95 | 4.98 | 5.03 | 4.94 |
| 3 | 4.97 | 5.06 | 4.91 | | | | | | |
| 4 | | | | | | | | | |
| 5 | | | | | | | | | |
| 6 | | | | | | | | | |

FIG. 7B

WD

| | 1 | 2 | 3 | 4 | 5 | 6 | 7 | 8 | 9 |
|---|---|---|---|---|---|---|---|---|---|
| 1 | 0 | 0 | 0 | 0 | 0 | 0 | 0 | 0 | 0 |
| 2 | 1 | -1 | 1 | -1 | 0 | -1 | -1 | 1 | -1 |
| 3 | 0 | 0 | -1 | -1 | | | | | |
| 4 | | | | | | | | | |
| 5 | | | | | | | | | |
| 6 | | | | | | | | | |

FIG. 8A

WD

| | 1 | 2 | 3 | 4 | 5 | 6 | 7 | 8 | 9 |
|---|---|---|---|---|---|---|---|---|---|
| 1 | 4.97 | 5.06 | 4.98 | 5.02 | 5.00 | 5.02 | 5.05 | 4.98 | 5.01 |
| 2 | 5.04 | 4.99 | 5.05 | 4.95 | 5.00 | 4.95 | 4.98 | 5.03 | 4.94 |
| 3 | 4.97 | 5.06 | 4.91 | 4.95 | | | | | |
| 4 | | | | | | | | | |
| 5 | | | | | | | | | |
| 6 | | | | | | | | | |

FIG. 8B

WD

| | 1 | 2 | 3 | 4 | 5 | 6 | 7 | 8 | 9 |
|---|---|---|---|---|---|---|---|---|---|
| 1 | 0 | 0 | 0 | 0 | 0 | 0 | 0 | 0 | 0 |
| 2 | 1 | -1 | 1 | -1 | 0 | -1 | -1 | 1 | -1 |
| 3 | 0 | 0 | -1 | -1 | | | | | |
| 4 | | | | | | | | | |
| 5 | | | | | | | | | |
| 6 | | | | | | | | | |

FIG. 9A

WD

| | 1 | 2 | 3 | 4 | 5 | 6 | 7 | 8 | 9 |
|---|---|---|---|---|---|---|---|---|---|
| 1 | 4.97 | 5.06 | 4.98 | 5.02 | 5.00 | 5.02 | 5.05 | 4.98 | 5.01 |
| 2 | 5.04 | 4.99 | 5.05 | 4.95 | 5.00 | 4.95 | 4.98 | 5.03 | 4.94 |
| 3 | 4.97 | 5.06 | 4.91 | 4.95 | | | | | |
| 4 | | | | | | | | | |
| 5 | | | | | | | | | |
| 6 | | | | | | | | | |

FIG. 9B

| | 1 | 2 | 3 | 4 | 5 | 6 | 7 | 8 | 9 |
|---|---|---|---|---|---|---|---|---|---|
| 1 | 0 | 0 | 0 | 0 | 0 | 0 | 0 | 0 | 0 |
| 2 | | | | | | | | | |
| 3 | | | | | | | | | |
| 4 | | | | | | | | | |
| 5 | | | | | | | | | |
| 6 | | | | | | | | | |

FIG. 12A

| | 1 | 2 | 3 | 4 | 5 | 6 | 7 | 8 | 9 |
|---|---|---|---|---|---|---|---|---|---|
| 1 | 4.97 | 4.99 | 4.98 | 5.02 | 5.00 | 5.02 | 4.98 | 4.98 | 5.01 |
| 2 | | | | | | | | | |
| 3 | | | | | | | | | |
| 4 | | | | | | | | | |
| 5 | | | | | | | | | |
| 6 | | | | | | | | | |

FIG. 12B

| | 1 | 2 | 3 | 4 | 5 | 6 | 7 | 8 | 9 |
|---|---|---|---|---|---|---|---|---|---|
| 1 | 0 | 0 | 0 | 0 | 0 | 0 | 0 | 0 | 0 |
| 2 | 1 | $\boxed{1}$ | 1 | -1 | 0 | -1 | $\boxed{1}$ | 1 | -1 |
| 3 | | | | | | | | | |
| 4 | | | | | | | | | |
| 5 | | | | | | | | | |
| 6 | | | | | | | | | |

FIG. 13A

| | 1 | 2 | 3 | 4 | 5 | 6 | 7 | 8 | 9 |
|---|---|---|---|---|---|---|---|---|---|
| 1 | 5.02 | 4.99 | 4.97 | 5.00 | 5.02 | 5.02 | 4.98 | 4.98 | 4.97 |
| 2 | 5.04 | 5.06 | 5.05 | 4.95 | 5.00 | 4.95 | 5.05 | 5.03 | 4.94 |
| 3 | | | | | | | | | |
| 4 | | | | | | | | | |
| 5 | | | | | | | | | |
| 6 | | | | | | | | | |

FIG. 13B

WD

| | 1 | 2 | 3 | 4 | 5 | 6 | 7 | 8 | 9 |
|---|---|---|---|---|---|---|---|---|---|
| 1 | 0 | 0 | 0 | 0 | 0 | 0 | 0 | 0 | 0 |
| 2 | 1 | 1 | 1 | -1 | 0 | -1 | 1 | 1 | -1 |
| 3 | 0 | 0 | 0 | -1 | | | | | |
| 4 | | | | | | | | | |
| 5 | | | | | | | | | |
| 6 | | | | | | | | | |

FIG. 14A

WD

| | 1 | 2 | 3 | 4 | 5 | 6 | 7 | 8 | 9 |
|---|---|---|---|---|---|---|---|---|---|
| 1 | 4.97 | 4.99 | 4.98 | 5.02 | 5.00 | 5.02 | 4.98 | 4.98 | 5.01 |
| 2 | 5.04 | 5.06 | 5.05 | 4.95 | 5.00 | 4.95 | 5.05 | 5.03 | 4.94 |
| 3 | 4.97 | 4.99 | 4.98 | 4.95 | | | | | |
| 4 | | | | | | | | | |
| 5 | | | | | | | | | |
| 6 | | | | | | | | | |

FIG. 14B

INKJET PRINTING APPARATUS

CROSS-REFERENCE TO RELATED APPLICATIONS

The present application claims priority to Korean Patent Application No. 10-2018-0158507 filed on Dec. 10, 2018, the entire disclosure of which is hereby incorporated by reference.

TECHNICAL FIELD

The present invention relates to an inkjet printing method and an inkjet printing apparatus.

BACKGROUND ART

When a layer having a micro thickness is formed through inkjet technology, it is important to maintain the micro thickness uniformly. Because of deviation in performance of nozzles for printing the layer, interference between the adjacent nozzles, and physical properties of ink, however, it is not easy to form the layer having the micro thickness, while achieving desired uniformity.

DISCLOSURE

Technical Problem

Accordingly, the present invention has been made in view of the above-mentioned problems occurring in the prior art, and it is an object of the present invention to provide an inkjet printing method and apparatus that is capable of setting a window on a portion of the whole printing area influenced by ink dots to determine control values of nozzles from which the ink dots are discharged so that the sum of quantities of ink discharged can be maintained to a given value when the ink dots are discharged onto the set window, and that is capable of adjusting the control values even when the nozzles have different discharge performance because the maintaining to the given value is based on the measured discharge performance of the nozzles from which separated ink quantities are discharged, so that print uniformity can be achieved.

It is another object of the present invention to provide an inkjet printing method and apparatus that is capable of setting control values, while sequentially moving a window over the whole printing area, so that in consideration of portions influenced by ink dots, the print uniformity of the whole printing area can be ensured, and that is capable of adjusting control signals applied with respect to the control values to the nozzles according to the discharge performance of the nozzles to minimize the deviation in the discharge performance of the nozzles, so that the compensation for the discharge performance of the nozzles can be carried out.

Technical Solution

To accomplish the above-mentioned objects, according to a first aspect of the present invention, there is provided an inkjet printing method using a plurality of nozzles adapted to be controlled, if given control values are inputted to the plurality of nozzles, to discharge separated ink quantities mapped to the given control values, the method including the steps of: inputting the control value mapped to a given separated ink quantity to the plurality of nozzles, measuring quantities of ink discharged from the plurality of nozzles, and determining discharge performance of the plurality of nozzles; calculating a target print ink quantity in case where a reference separated ink quantity is discharged from a plurality of dots on a window having the plurality of dots constituting at least two or more rows and columns determined based on print resolution (dpi); and determining the control values of the plurality of nozzles based on the discharge performance of the plurality of nozzles to allow the sum of quantities of ink discharged of ink dots injected into the window to be maintained to the target print ink quantity.

According to the present invention, desirably, the step of determining the control values of the plurality of nozzles is carried out by designating one dot in the window as a reference dot, so that while the reference dot is being moved sequentially, the control values of the plurality of nozzles are determined over the whole printing area.

According to the present invention, desirably, the step of determining the control values of the plurality of nozzles includes the steps of: determining the control values of the row or column located on the outermost position of the whole printing area as the control values mapped to the reference separated ink quantity; and determining the control values of the row or column adjacent to the row or column on the outermost position of the whole printing area through the comparison between the given separated ink quantity and the quantities of ink actually measured.

According to the present invention, desirably, the number of dots in the window is proportional to the print resolution.

According to the present invention, desirably, the inkjet printing method further includes the step of, if a difference between the separated ink quantities mapped to the control values and the quantities of ink actually discharged is over a value in advance set in the measured discharge performance of the plurality of nozzles, adjusting control signals applied with respect to the control values to the plurality of nozzles.

According to the present invention, desirably, the value in advance set corresponds to an interval of the quantities of ink discharged from the nozzles caused by a difference between the adjacent control values.

To accomplish the above-mentioned objects, according to a second aspect of the present invention, there is provided an inkjet printing apparatus having a plurality of nozzles adapted to be controlled, if given control values are inputted to the plurality of nozzles, to discharge separated ink quantities mapped to the given control values, the apparatus including: a nozzle performance measuring circuit for inputting the control value mapped to a given separated ink quantity to the plurality of nozzles, measuring quantities of ink discharged from the plurality of nozzles, and determining discharge performance of the plurality of nozzles; and a control circuit for calculating a target print ink quantity in case where a reference separated ink quantity is discharged from a plurality of dots on a window having the plurality of dots constituting at least two or more rows and columns determined based on print resolution (dpi) and for determining the control values of the plurality of nozzles based on the discharge performance of the plurality of nozzles to allow the sum of quantities of ink discharged of ink dots injected into the window to be maintained to the target print ink quantity.

According to the present invention, desirably, the control circuit designates one dot in the window as a reference dot and determines the control values of the plurality of nozzles over the whole printing are, while the reference dot is being moved sequentially.

According to the present invention, desirably, the control circuit determines the control values of the row or column located on the outermost position of the whole printing area as the control values mapped to the reference separated ink quantity and determines the control values of the row or column adjacent to the row or column on the outermost position of the whole printing area through the comparison between the given separated ink quantity and the quantities of ink actually measured.

According to the present invention, desirably, the inkjet printing apparatus further includes a nozzle managing circuit for adjusting control signals applied with respect to the control values to the plurality of nozzles if a difference between the separated ink quantities mapped to the control values and the quantities of ink actually discharged is over a value in advance set in the measured discharge performance of the plurality of nozzles.

According to the present invention, desirably, the inkjet printing apparatus includes a physical recording medium in which a program for performing the inkjet printing method is recorded.

According to the present invention, desirably, the inkjet printing apparatus includes a program recorded in a physical recording medium adapted to perform the inkjet printing method.

Advantageous Effects

According to the present invention, the inkjet printing method and apparatus is capable of setting the window on a portion of the whole printing area influenced by the ink dots to determine the control values of the nozzles, so that a given quantity of ink is discharged onto the set window, and even when the nozzles have different discharge performance, accordingly, print uniformity is achieved.

According to the present invention, in addition, the inkjet printing method and apparatus is capable of setting the control values, while sequentially moving the window over the whole printing area, so that the print uniformity of the whole printing area is ensured, and are capable of adjusting the control signals applied with respect to the control values to the nozzles according to the discharge performance of the nozzles to minimize the deviation in the discharge performance of the nozzles, so that the compensation for the discharge performance of the nozzles can be carried out to make a uniform printed layer.

BRIEF DESCRIPTION OF DRAWINGS

FIGS. 4A and 4B show a process for determining the control values for the outermost rows or columns before the control value for a given dot is determined through the movement of the window, as discussed with reference to FIGS. 3A to 3E.

FIGS. 5A and 5B show a process for determining the control values for the second row on the whole printing area after the control values for the first row on the whole printing area have been determined.

FIGS. 6A and 6B show control values and quantities of ink discharged so as to explain the process for determining the control values on the window WD located as shown in FIG. 3A.

FIGS. 7A and 7B show the control values and the quantities of ink discharged as determined in FIGS. 6A and 6B.

FIGS. 8A and 8B show control values and quantities of ink discharged when the window moves, as shown in FIG. 3B.

FIGS. 9A and 9B show the process for determining the control values and the quantities of ink discharged in case where the window moves, as shown in FIG. 3C, after the determination in FIGS. 8A and 8B.

FIGS. 12A to 14B show processes for applying control values to the whole printing area again according to adjusted control signals.

MODE FOR INVENTION

Figure 1A:
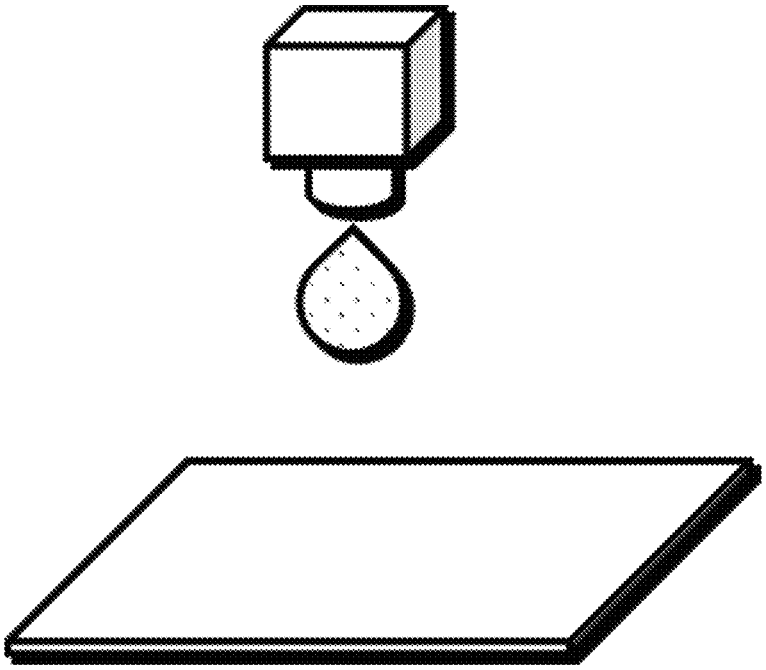
FIGS. 1A and 1B are schematic views showing ink discharged from a nozzle in an inkjet printing method according to the present invention.

Hereinafter, the present invention will be in detail given with reference to the attached drawing. If it is determined that the detailed explanation on the well known technology related to the present invention makes the scope of the present invention not clear, the explanation will be avoided for the brevity of the description. In the description, it should be noted that the parts corresponding to those of the drawings are indicated by corresponding reference numerals. For the brevity of the description, an apparatus and a method will be explained together if necessary.

Figure 1B:
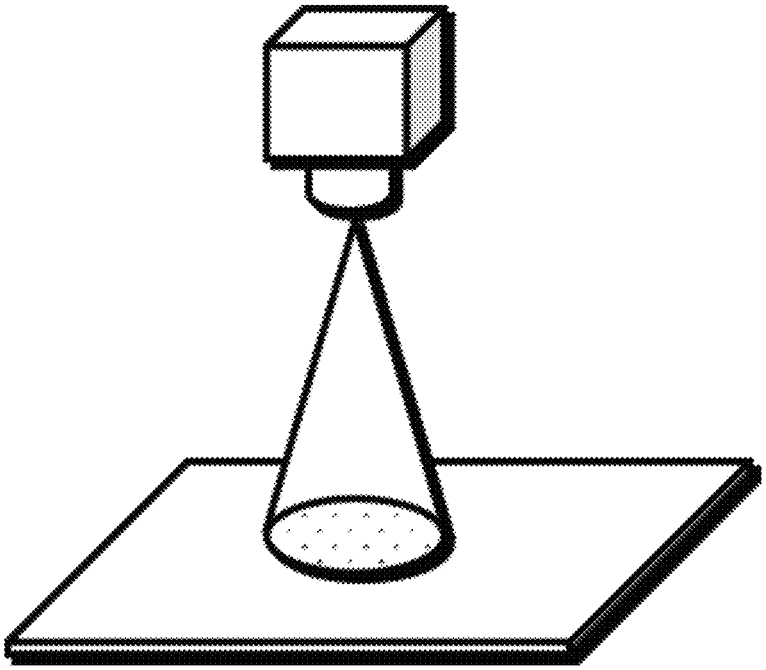

FIGS. 1*a* and 1*b* are schematic views showing ink discharged from a nozzle in an inkjet printing method according to the present invention. FIG. 1A shows a shape of a droplet discharged from a nozzle before the droplet is seated onto a surface to be printed, and FIG. 1B shows a state wherein the droplet discharged from the nozzle is seated onto the surface to be printed.

According to the present invention, an inkjet printing method and apparatus performs inkjet printing by means of a plurality of nozzles. As separated ink quantities are mapped to control values, if a given control value is inputted, the plurality of nozzles discharges the separated ink quantities mapped to the given control value therefrom. In detail, the plurality of nozzles discharges the ink quantities having the separated values according to the input of the control values, and in this case, the control values and the separated ink quantities mapped to the control values are determined upon a user's setting. It can be understood that the control values also have separated values. So as to express the control values having the separated values, however, currents or voltages continuously varied can be used. The currents or voltages provided to apply the control values are called control signals, which will be discussed later.

The nozzles controlled to discharge the separated ink quantities according to the control values are called grayscale nozzles, and the control values inputted to the nozzles are called grayscale values. The separated ink quantities changed stepwise are discharged from the nozzles according to the grayscale values. According to the present invention, the ink quantities set to be discharged from the nozzles through an injection operation one time will be explained as the separated ink quantities.

If the control value to which the same separated ink quantity is mapped is inputted to the respective nozzles, it can be expected that the same quantity of ink will be discharged from the nozzles. However, different quantities of ink may be discharged from the nozzles according to the discharge performance of the nozzles.

Even if the control value with which a separated ink quantity of 5.00 pl is discharged from each nozzle is inputted, for example, the respective nozzles may discharge different ink quantities of 4.96 to 5.05 pl. Due to such difference in the ink quantities actually discharged, the printed layer formed by means of the plurality of nozzles may be not uniform in thickness.

Like this, the same separated ink quantity is not discharged from the nozzles according to the discharge performance of the nozzles, and accordingly, the different separated ink quantities are discharged from the nozzles. So as to measure the discharge performance of each nozzle, as a result, a shape of a droplet discharged from the nozzle before the droplet is seated onto a surface to be printed is momentarily photographed, as shown in FIG. 1A, and the volume of the photographed droplet can be calculated based on the radius and length of the droplet. In consideration of spreading of the droplet after discharged from the nozzle and then seated onto the surface to be printed, as shown in FIG. 1B, the volume of the discharged droplet can be also calculated based on the radius, width and height of the droplet seated on the surface or the characteristics of the discharged droplet. According to the present invention, at least one of the two methods is selected to determine the discharge performance of the nozzle, and of course, another method may be adopted to do this.

Hereinafter, one droplet discharged from the nozzle is called an ink dot, and an explanation on a method for controlling the separated ink quantities as desired to be discharged from the nozzles and the quantities of ink in the ink dots, that is, the quantities of ink discharged to allow uniform quantities of ink to be printed on a given area will be given.

Figure 2:
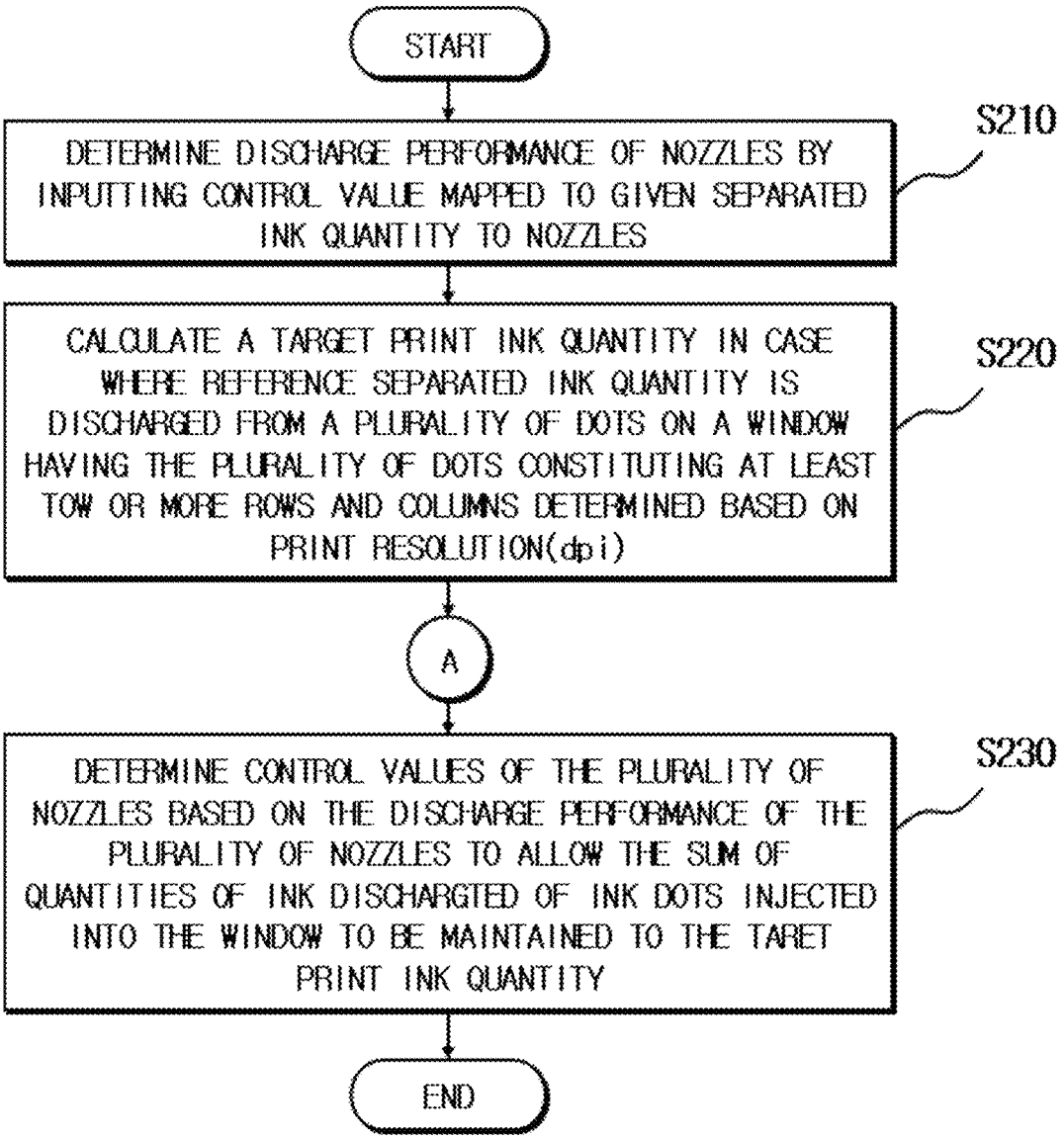
FIG. 2 is a flowchart showing the inkjet printing method according to the present invention.

FIG. 2 is a flowchart showing the inkjet printing method according to the present invention.

As shown in FIG. 2, the control values to which given separated ink quantities are mapped are inputted to the plurality of nozzles, thereby determining the discharge performance of the nozzles at step S210.

For example, one control value is inputted to the plurality of nozzles to measure the quantities of ink actually discharged, that is, the quantities of ink in the ink dots, thereby determining the discharge performance of the nozzles. While various control values are being inputted, otherwise, the volumes of the ink dots injected from the nozzles are measured to determine the discharge performance of the nozzles. While the same control value is inputted to the nozzles, on the other hand, discharging is carried out multiple times, and an average from the discharging results is obtained, thereby determining the discharge performance of the nozzles.

For example, control values of "−1", "0", and '1" are inputted to nine nozzles, so that quantities of ink discharged as listed in Table 1 can be measured.

TABLE 1

| | Control value | | |
|---|---|---|---|
| Nozzle No. | −1 | 0 | 1 |
| 1 | 4.90 | 4.97 | 5.04 |
| 2 | 4.99 | 5.06 | 5.13 |
| 3 | 4.91 | 4.98 | 5.05 |
| 4 | 4.95 | 5.02 | 5.09 |
| 5 | 4.93 | 5.00 | 5.07 |
| 6 | 4.95 | 5.02 | 5.09 |
| 7 | 4.98 | 5.05 | 5.12 |
| 8 | 4.92 | 4.98 | 5.03 |
| 9 | 4.94 | 5.01 | 5.08 |

A separated ink quantity of 5.00 pl is mapped to the control value of "0", 4.93 pl to the control value of "−1", and 5.07 pl to the control signal of "1", so that it is expected that the ink quantities corresponding to the separated ink quantities will be discharged from the nine nozzles. However, it is checked that there are deviations between the quantities of ink discharged from other nozzles except the nozzle No. 5 and their separated ink quantities.

Like this, the quantities of ink discharged from the nozzles are different according to the discharge performance of the nozzles, and according to the present invention, a window having at least two or more rows and columns is set in consideration of neighboring ink dots influenced by a given ink dot according to print resolution (dpi). The rows and columns in the window are areas into which ink dots are injected, and the components constituting the rows and columns are called dots. The higher the print resolution is, the larger the number of ink dots influenced by one ink dot becomes. Accordingly, the real size of the window is the same, but as the print resolution becomes high, the number of ink dots in the window is increased. An explanation on the increment in the number of ink dots will be in detail given later with reference to FIGS. 16A and 16B.

A reference separated ink quantity as desired to be discharged is set to the plurality of ink dots in the window. In detail, the reference separated ink quantity corresponds to a thickness of ink as desired to allow the reference separated ink quantity to be uniformly printed over the whole printing area.

The window having three rows and three columns includes nine dots. If the separated ink quantity of 5.00 pl mapped to the control value of "0" is the reference separated ink quantity, a target print ink quantity becomes 45.00 pl because ink dots of 5.00 pl are nine times injected into the window. The target print ink quantity is calculated by multiplying the reference separated ink quantity by the number of ink dots in the window. According to the present invention, the control values for the nozzles are determined to allow the target print ink quantity of 45.00 pl to be finally injected into the window.

In summary, in case where the reference separated ink quantity is discharged from the plurality of dots in the window determined based on the print resolution, the corresponding target print ink quantity is calculated at step S220.

Based on the measured quantities of ink discharged actually from the nozzles, the control values for the nozzles are determined to allow a target print ink quantity in advance set within the corresponding window in a unit of the window having the plurality of dots to be maintained.

A method for allowing the target print ink quantity in advance set within the corresponding window to be maintained may be carried out in various ways.

FIGS. 3A to 3E show relationships between the whole printing area, the dots, and the window to explain the inkjet printing method according to the present invention.

As shown in FIGS. 3A to 3E, rows of dots are formed in a direction of x axis, and columns of dots in a direction of y axis, which will be also explained with the same reference as mentioned above in the drawings as will be discussed later. According to the present invention, as a plurality of nozzles N1 to N9 moves in the direction of y axis, they perform printing along one column, but of course, their moving direction may be changed.

In FIGS. 3A to 3E, for example, inkjet printing is performed with the print resolution of 100×100 dpi, but the print resolution of 100×100 dpi may be relatively low print resolution. It is assumed that one ink dot has an influence on the neighboring eight ink dots as shown in FIGS. 3A to 3E, and the window WD has a size of three rows×three columns.

Accordingly, the window WD has nine dots, and ink is injected into the nine dots from the nozzles, thereby forming the ink dots. According to the present invention, one dot of the dots constituting the window WD is designated as a reference dot RD, and as the reference dot RD moves by one row or one column, the control values for the nozzles are determined to allow the quantities of ink discharged in the window WD to correspond to the target print ink quantity.

Figure 3A:
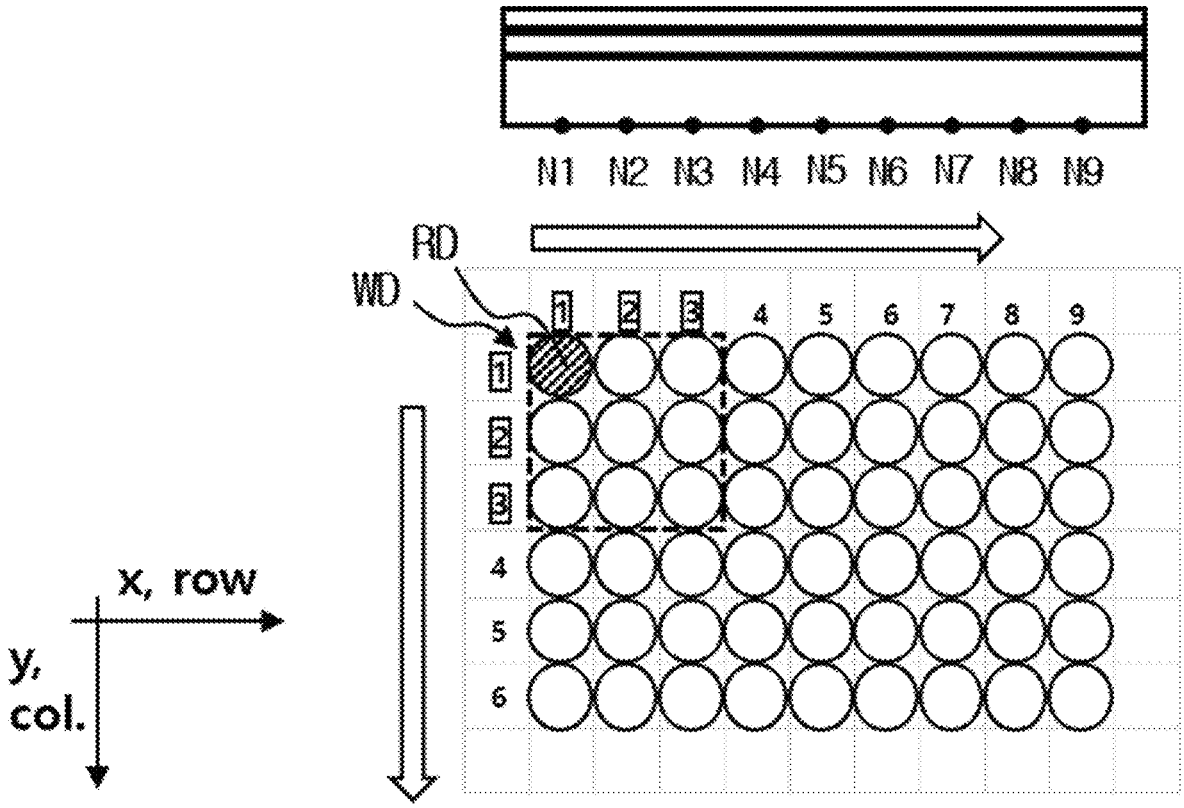
FIGS. 3A to 3E are schematic views showing relationships between the whole printing area, dots, and a window in the inkjet printing method according to the present invention.

As shown in FIGS. 3A to 3E, the dot located on the uppermost position of the left side of the window is the reference dot RD, and the reference dot RD is indicated through hatching. As shown in FIG. 3A, the reference dot RD of the window WD is located at a first row and a first column, and the window WD is disposed on an area having first to third rows and first to third columns. Ink is injected from the first to third nozzles N1, N2 and N3 to print the corresponding window WD, and based on the discharge performance of the first to third nozzles N1, N2 and N3, the control values for the nozzles are determined to allow the sum of quantities of ink discharged of the nine ink dots to become the target print ink quantity (in this case, 45.00 pl).

Figure 3B:
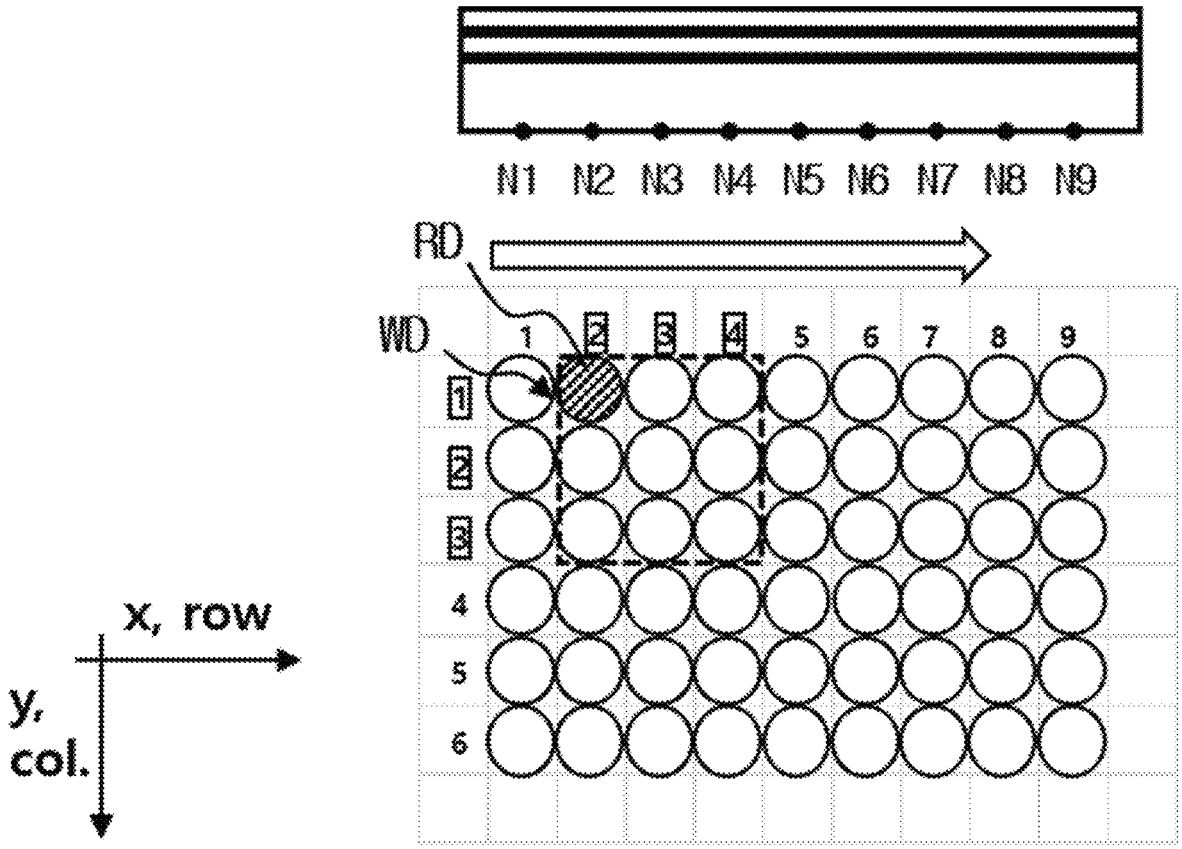

As shown in FIG. 3B, the reference dot RD of the window WD is located at the first row and the second column, and accordingly, the window WD is disposed on an area having the first to third rows and the second to fourth columns. Based on the discharge performance of the second to fourth nozzles N2, N3 and N4, the control values for the nozzles are determined to allow the sum of quantities of ink discharged of the nine ink dots to become the target print ink quantity.

Figure 3C:
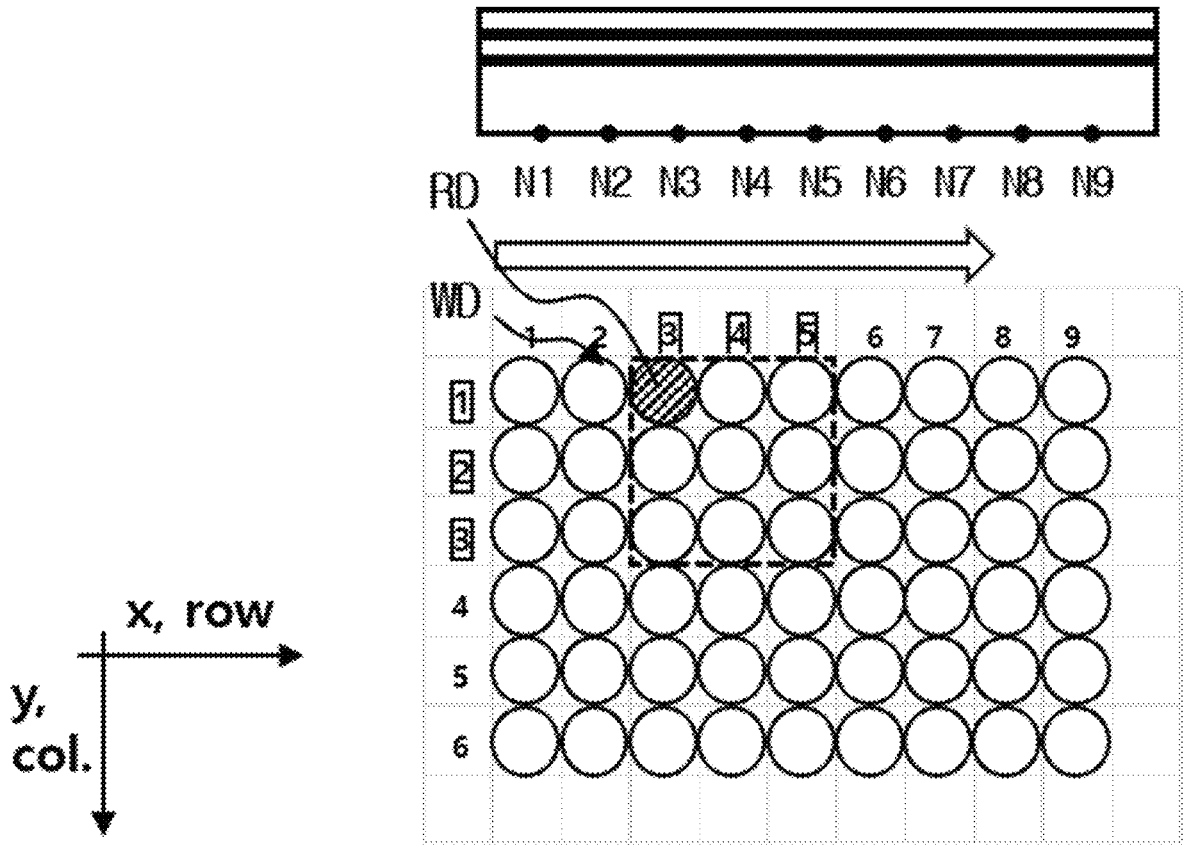

As shown in FIG. 3C, the reference dot RD of the window WD moves by one column in the direction of x axis and is thus located at the first row and the third column. Accordingly, the window WD is disposed on an area having the first to third rows and the third to fifth columns. Based on the discharge performance of the third to fifth nozzles N3, N4 and N5, the control values for the nozzles are determined to allow the sum of quantities of ink discharged of the nine ink dots to become the target print ink quantity.

Figure 3D:
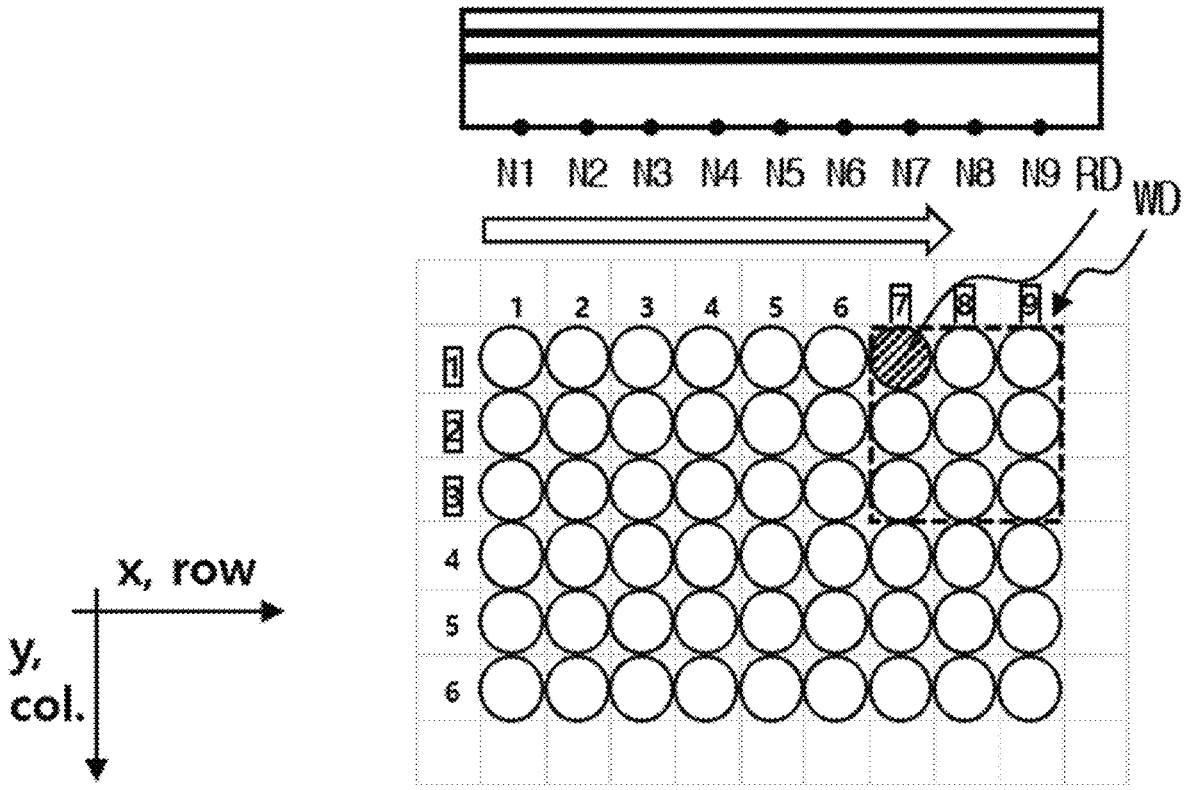
Figure 3E:
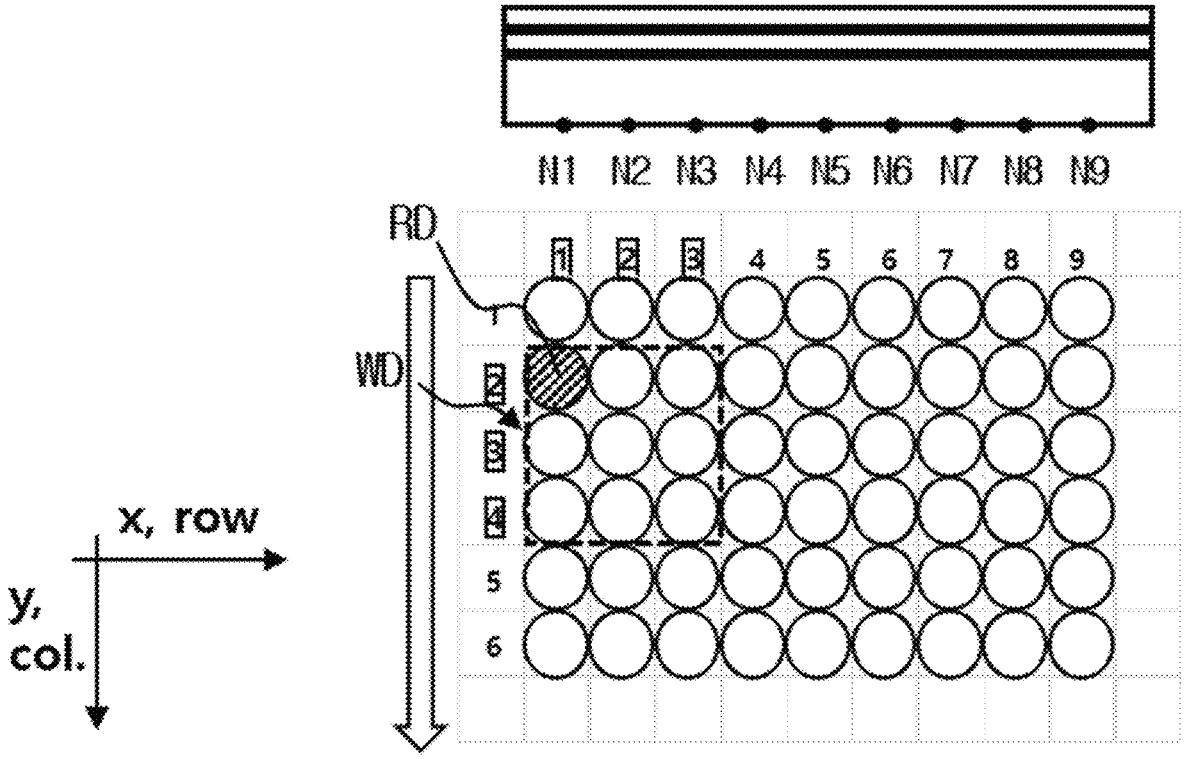

After the control values for all columns of the first to third rows are determined as shown in FIG. 3D, the reference dot RD of the window WD moves by one row and is thus located at the second row and the first column as shown in FIG. 3E.

According to the present invention, the window WD moves, while maintaining the area overlapped with the window WD before the window WD. In detail, if the reference dot RD of the window WD is located at the first row and the first column as shown in FIG. 3A, the reference dot RD of the window WD may not move to the fourth row and the first column wherein no area is overlapped with the window WD located at the first row and the first column in determining the control values, and accordingly, the windows WD move sequentially, while having the areas overlapped with the windows WD determined before them.

This is because all ink dots sequentially have influences on the ink dots adjacent thereto, and therefore, the target print ink quantity on the area corresponding to the surroundings around one ink dot is determined, thereby ensuring print uniformity.

According to the present invention, the control values for the nozzles may be determined randomly to allow the sum of ink quantities discharged of the nine dots in the window WD to be finally 45.00 pl.

In case where the discharge performance of the nozzles is measured as listed in Table 1, if the control values for the first to third nozzles with respect to the nine dots in the window WD are inputted to "0", the sum of ink quantities discharged is 45.03 pl. However, if correction is performed to allow the sum of ink quantities discharged to be close to 45.00 pl, or otherwise, if other control values for the nine dots are inputted, the sum of ink quantities discharged may have the value similar thereto.

For example, if the control values for the first nozzle N1 are inputted to "−1", "0", and "1" when the first nozzle N1 injects ink into the first to third columns, the sum of ink quantities discharged from the first nozzle N1 is 14.91 pl made by adding 4.90 pl+4.97 pl+5.04 pl, and if the control values for the second nozzle N2 are inputted to "−1", "0", and "−1" when the second nozzle N2 injects ink into the first to third columns, the sum of ink quantities discharged from the second nozzle N2 is 15.04 pl made by adding 4.99 pl+5.06 pl+4.99 pl. Further, if the control values for the third nozzle N3 are inputted to "0", "1", and "1" when the third nozzle N3 injects ink into the first to third columns, the sum of ink quantities discharged from the third nozzle N3 is 15.08 pl made by adding 4.98 pl+5.05 pl+5.05 pl. Therefore, the sum of ink quantities discharged in the window WD is 45.03 pl made by adding 14.91 pl+15.04 pl+15.08 pl.

Like this, even if the different control values for each nozzle are inputted, the sum of ink quantities discharged is the same as when the control value of "0" for each nozzle is inputted, and according to the present invention, also, the print uniformity may be improved. According to the present invention, furthermore, a process for inputting different control values for each nozzle may be added so as to constantly maintain the sum of ink quantities discharged in the window WD and to prevent formation of a pattern when the same control value for each nozzle is continuously inputted.

According to the present invention, further, at the time when the control values for the dots in the window WD are determined based on the discharge performance of the second to fourth nozzles N2, N3 and N4 as shown in FIG. 3B, if the control value of "0" for the second to fourth columns and the first to third rows is inputted, the sum of ink quantities discharged in the window WD is 45.18 pl. Under such result, ink having a quantity by 0.18 pl larger than the target print ink quantity is injected, which hinders print uniformity.

As the control values for the respective dots are adjusted, accordingly, the sum of ink quantities discharged from the nozzles has to be close to the target print ink quantity.

On the other hand, if the control values for all dots in the window WD are determined randomly, the number of cases for determining the control values becomes large to increase the time consumed in operation. According to the present invention, control values for the outermost rows or columns of the whole printing area based on the size of the window WD are determined in advance, and as the window WD moves, the control values for the dots whose control values are not determined are determined. A method for in advance determining the control values may be carried out in various ways.

If the window WD has a size of three rows×three columns, for example, the control values for the outermost two rows or columns are determined in advance. In detail, after the control value for every row or column except the last row or column is determined in advance, the control values for the remaining dots are determined.

According to the present invention, otherwise, the control value for every dot except one dot in the window may be determined in advance.

FIGS. 4A and 4B show a process for determining the control values of the outermost rows or columns before the control value for a given dot is determined through the movement of the window, as discussed above with reference to FIGS. 3A to 3E.

As shown in FIGS. 4A to 9B, and FIGS. 12A to 13B, tables having the rows and columns on the whole printing area are indicated, and the values indicated in the table of FIGS. 4A to 9A, 12A, and 13A mean the control values, and the values indicated in the table of FIGS. 4B to 9B, 12B, and 13B mean the quantities of ink discharged. For example, the fourth columns of FIGS. 4A and 4B indicate the control values inputted when the fourth nozzle N4 discharges ink to the dots of the first to six rows and the quantities of ink discharged according to the control value.

As shown in FIG. 4A, the control values of "0" for the first row in the outermost position of the whole printing area are inputted. As shown in FIG. 4B, even in case where the same control value of "0" is inputted, it can be checked that the quantities of ink discharged from the nozzles are different according to the discharge performance of the nozzles.

FIGS. 5A and 5B show a process for determining the control values for the second row on the whole printing area after the control values for the first row on the whole printing area have been determined.

As shown in FIGS. 5A and 5B, based on the quantities of ink actually discharged to the first row of the whole printing area, that is, the values indicated on the first row of FIG. 4B, if the discharged ink quantities are smaller than the separated ink quantities mapped to the control values, that is, 5.00 pl, the control value of "1" greater than the control values of "0" is applied so as to compensate for the discharged ink quantities, and contrarily, if the discharged ink quantities are larger than the reference separated ink quantities, the control value of "−1" less than the control value of "0" is applied so as to compensate for the discharged ink quantities.

First, as shown in FIG. 5A, the control value of "1" is applied to the second row of the first, third and eighth columns having the quantities of ink discharged on the first row thereof smaller than 5.00 pl, and the control value of "−1" is applied to the second row of the second, fourth, sixth and ninth columns having the quantities of ink discharged on the first row thereof larger than 5.00 pl. On the other hand, the control value of "0" is applied to the fifth nozzle N5 having the quantity of ink discharged equal to the reference separated ink quantity (the separated ink quantity mapped to the control value of "0") of 500 pl.

FIG. 5B shows the quantities of ink discharged from the respective nozzles according to the control values applied as shown in FIG. 5A.

As shown in FIGS. 4A to 5B, after the control values for the outermost two rows are determined, the process for determining the control values is carried out so as to allow the sum of quantities of ink discharged of the plurality of ink dots constituting the window WD to be the same value as the target print ink quantity. Hereinafter, the process will be explained with reference to FIGS. 6A and 6B.

According to the present invention, however, the control values for the rows are determined at the initial steps, but of course, it is possible to determine the control values for the columns.

FIGS. 6A and 6B show the control values and quantities of ink discharged so as to explain the process for determining the control values on the window WD located as shown in FIG. 3A.

Since the control values for only the two rows of the whole printing area are determined, there is no need to determine control values for all of first to third columns of the third row. According to the present invention, however, the control value of "0" may be applied simply to the first and second columns, and the control value for only the third column of the third row may be determined. Of course, a method for determining the control values for the first and second columns of the third row may be carried out in various ways.

After the control values as shown in FIGS. 6A and 6B are determined, the control value for the third column of the third row has to be determined.

According to the present invention, the sum of quantities of ink discharged in the window WD as shown in FIG. 6B should become 45.00 pl. According to the control values determined up to now, the sum of quantities of ink discharged of the ink dots in the window WD as shown in FIG. 6B is 40.12 pl made by adding 4.97 pl+5.06 pl+4.98 pl+5.04 pl+4.99 pl+5.05 pl+4.97 pl+5.06 pl. Accordingly, most desirably, a quantity of ink of 4.88 pl has to be discharged to the dot of the three column of the third row. At the time when the control value of "−1" is inputted, based on the discharge performance of the third nozzle N3, a quantity of ink discharged is 4.91 pl which is closest to 4.88 pl. Accordingly, the control value for the dot of the three column of the third row is determined as shown in FIG. 7A, and next, the quantity of ink discharged is determined as shown in FIG. 7B.

After the control value for the corresponding dot is determined, the reference dot RD of the window WD moves, which is shown in FIGS. 8A and 8B.

As shown in FIGS. 8A and 8B, a control value for the dot of the fourth column of the third row on the whole printing area is determined. The sum of quantities of ink discharged in the window WD except the quantity of ink of the fourth column of the third row is 40.02 pl. So as to allow the sum of quantities of ink discharged to correspond to the target print ink quantity, accordingly, a quantity of ink of 4.98 pl has to be injected into the dot of the fourth column of the third row. However, the nozzles used in the present invention are mapped to the separated ink quantities, and therefore, the same quantity of ink as the quantity of ink of 4.98 pl cannot be discharged. Accordingly, if the control value of "−1" is inputted based on the discharge performance of the fourth nozzle N4, a quantity of ink of 4.95 pl is discharged, so that most desirably, the sum of quantities of ink discharged in the window WD becomes 44.97 pl.

After the control value for the dot of the fourth column of the third row is determined, the window WD moves along the movement of the reference dot RD, which is shown in FIGS. 9A and 9B. After the control values are determined in the initial steps, like this, only the control value of one dot is determined, while the window WD is moving.

As shown in FIGS. 9A and 9B, a control value for the dot of the fifth column of the third row is determined. The sum of quantities of ink discharged in the window WD except the quantity of ink of the fifth column of the third row is 39.86 pl. So as to allow the sum of quantities of ink discharged to correspond to the target print ink quantity on the window WD, accordingly, a quantity of ink of 5.15 pl has to be injected into the dot of the fifth column of the third row. By the way, a quantity of ink discharged larger than a quantity of ink of 5.07 pl when the control value of "1" is inputted according to the discharge performance of the fifth nozzle N5 has to be required. In detail, there is a need to input a control value of "2", but in this case, a big difference in the quantities of ink discharged between the dot and other dots occurs, thereby ensuring no good print uniformity.

According to the present invention, as mentioned above, the window is set on the whole printing area, and as the window moves sequentially in a unit of row or column, the control values for the corresponding dots are determined to allow the sum of quantities of ink discharged in the window to reach the target print ink quantity. However, if a difference in the quantities of ink discharged or the control values between the given dot and other dots becomes big, there is a need to adjust the quantity of ink or the control value for the given dot.

For example, if the control value for the given dot is over a range in advance set (in the range of −1 to 1), if a difference in the quantities of ink discharged from the adjacent nozzles with respect to the same control value as each other is over a value in advance set, according to time intervals in advance set, or if the quantity of ink discharged from the nozzle is different from the separated ink quantity mapped by a value in advance set and above, the quantities of ink discharged from the nozzles are monitored to adjust the control values mapped to the separated ink quantities of the nozzles.

Figure 10:
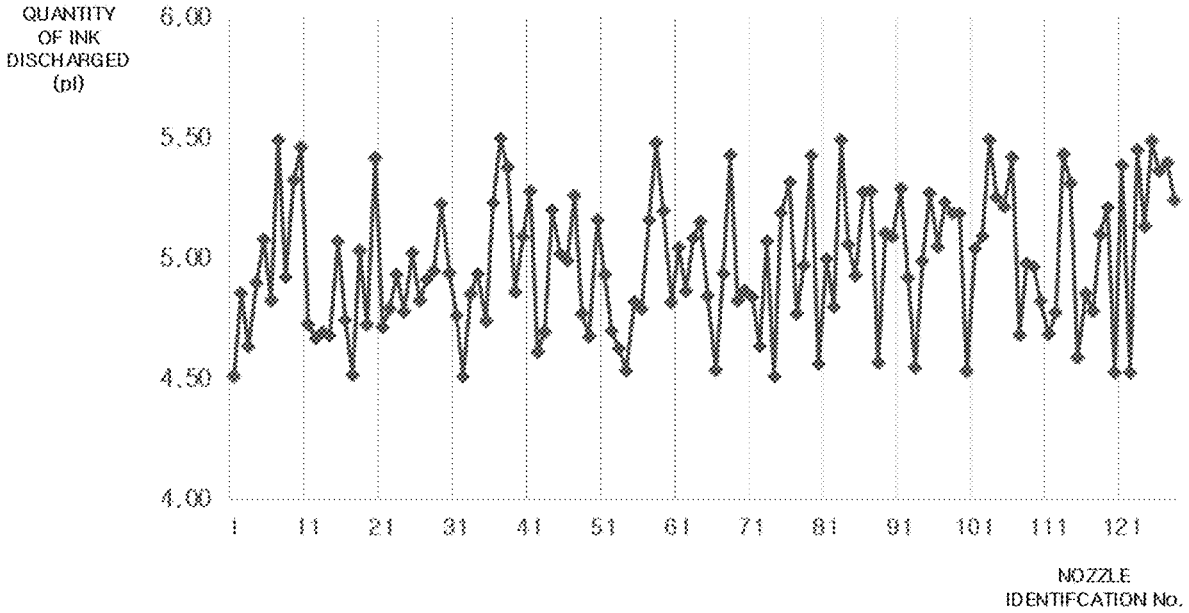
FIG. 10 is a graph showing the monitoring results of the discharge performance of a plurality of nozzles according to the present invention.

FIG. 10 is a graph showing the monitoring results of the discharge performance of the plurality of nozzles according to the present invention.

As shown in FIG. 10, in case where the control values are inputted to the nozzles to discharge the separated ink quantity of 5.00 pl, the quantities of ink discharged from the nozzles are monitored.

As mentioned above, if the given control values are inputted to the nozzles used in the inkjet printing method according to the present invention, the separated ink quantities mapped to the given control values are discharged. If the control values of all nozzles and the separated ink quantities mapped to the control values are the same, the same control values of all nozzles may be inputted to allow the quantities of ink discharged from the nozzles to be actually same.

As shown in FIG. 10, it can be checked that the quantities of ink discharged from the nozzles are differently distributed around 5.00 pl. Even if the control values are inputted to allow the same quantities of ink discharged to be discharged from the nozzles, different quantities of ink are discharged from the nozzles because the discharge performance of the nozzles is different.

It is expected that the same quantity of ink discharged is discharged from the nozzles, but the different quantities of ink are discharged from the nozzles, thereby failing to achieve good print uniformity. So as to improve the uniformity of the printed layer, in this case, control signals applied with respect to the control values inputted to the nozzles can be adjusted.

Figure 11:
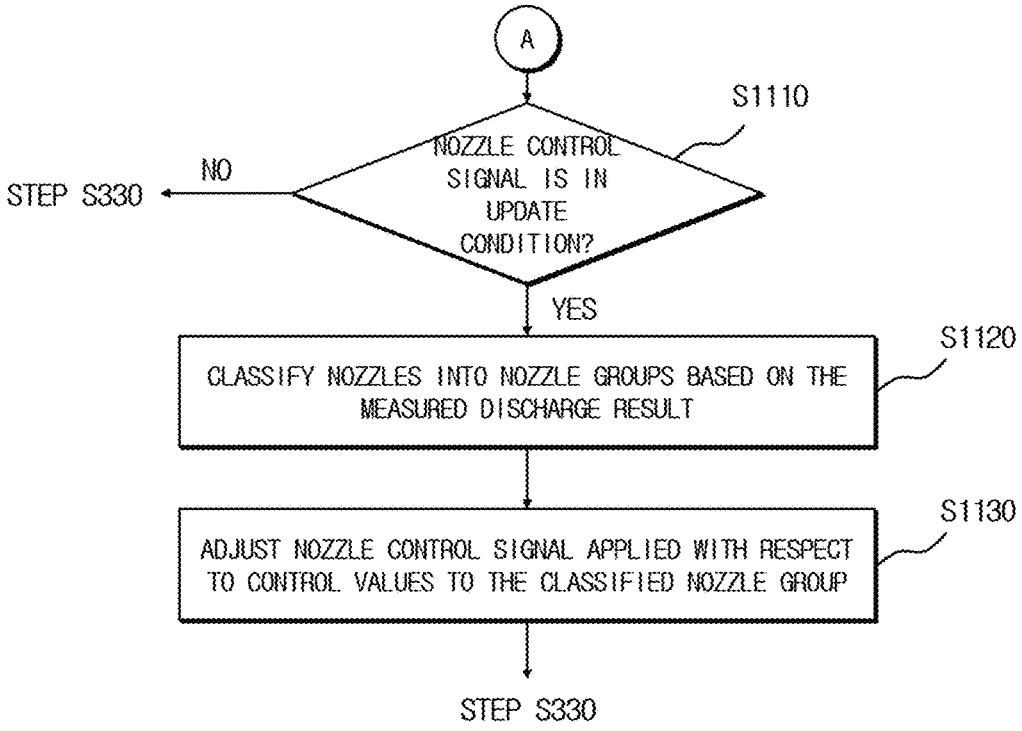
FIG. 11 is a flowchart showing a process for adjusting control signals according to the discharge performance of the nozzles.

FIG. 11 is a flowchart showing a process for adjusting the control signals according to the discharge performance of the nozzles. FIG. 11 shows the process at the point A of FIG. 2, but the adjustment of the control signals may be carried out before the control values of the respective dots along the window WD are determined.

According to the discharge results of the ink from the nozzles, the ink discharged from each nozzle is observed and the quantity of ink is calculated, as shown in FIGS. 1A and 1B. As listed in Table 1, it can be understood that the quantities of ink discharged from the nozzles are the discharge performance of the nozzles. However, of course, the quantities of ink discharged from the nozzles may be measured or expected in various ways.

For example, the kinds and/or characteristics of ink supplied to the nozzles are different, and otherwise, a plurality of discharge operations are carried out from the nozzles to calculate an average separated ink quantity measured therefrom, thereby determining the calculated average separated ink quantity as the discharge performance of the corresponding nozzle.

As mentioned above, it is determined whether control signals for the nozzles are in update conditions at step S1110, and if the control signals for the nozzles are not in the update conditions at the step S1110, the process for determining the control values by dot according to the movement of the window WD is still repeatedly carried out, as mentioned above.

However, if it is determined that the control signals for the nozzles are in the update conditions at the step S1110, the plurality of nozzles are classified into a plurality of nozzle groups based on their discharge performance at step S1120. Also, of course, the method for classifying the plurality of nozzles into the plurality of nozzle groups may be carried out in various ways.

In case where the plurality of nozzles has various discharge performance in the range of 4.50 to 5.50 pl, as shown in FIG. 10, the nozzles according to their measured discharge performance are divided into a plurality of sections, thereby being classified into the nozzle groups. According to the present invention, the plurality of nozzles may be classified into the plurality of nozzle groups according to their control level values (for example, grayscale level values).

The control level values with which the nozzles are controlled correspond to the number of control steps for sensing the control values for the nozzles to discharge the separated ink quantities. As the plurality of nozzles are classified into the plurality of nozzle groups to allow the nozzles to correspond to the control level values, the control signals applied with respect to the control values mapped to the same separated ink quantities are adjusted differently by nozzle group.

In detail, the step of classifying the plurality of nozzles into the plurality of nozzle groups includes the steps of selecting the whole classification group of the nozzles to be classified and determining a reference for classifying the nozzles in the selected classification group to classify the nozzles into the plurality of nozzle groups according to the determined reference.

First, in case where the measured discharge performance of the nozzles is distributed in the given range, as shown in FIG. 10, all of the nozzles may be included in the classified nozzle groups, but if there are the nozzles having large deviations in their measured discharge performance, the nozzles having the large deviations are excluded from the classified nozzle groups.

Table 2 shows the equally divided ranges of quantities of ink discharged from the nozzles if the same control value is inputted to the nozzles and the discharge performance indexes applied to the ranges.

TABLE 2

| Discharge performance index | Quantity of ink actually discharged (pl) | Separated ink quantity (pl) |
|---|---|---|
| −7 | 4.50-4.54 | 4.50 |
| −6 | 4.55-4.61 | 4.57 |
| −5 | 4.62-4.68 | 4.64 |
| −4 | 4.69-4.75 | 4.71 |
| −3 | 4.76-4.82 | 4.79 |
| −2 | 4.83-4.89 | 4.86 |
| −1 | 4.90-4.96 | 4.93 |
| 0 | 4.97-5.03 | 5.00 |
| 1 | 5.04-5.10 | 5.07 |
| 2 | 5.11-5.17 | 5.14 |
| 3 | 5.18-5.24 | 5.21 |
| 4 | 5.25-5.31 | 5.29 |
| 5 | 5.32-5.38 | 5.36 |
| 6 | 5.39-5.45 | 5.43 |
| 7 | 5.46-5.50 | 5.50 |

For example, if the control value of "0" is inputted to the plurality of nozzles at their initial step, the plurality of nozzles is mapped accurately to discharge the separated ink quantity of 5.00 pl, and the control signal recognized as the control value of "0" may be set with the same control value. As mentioned above, each nozzle recognizes the control value thereof according to the control signal.

Even if the control signal is applied to allow the control value of "0" to be inputted, by the way, it is observed that quantities of ink in the range of 4.50 to 5.50 pl (as shown in FIG. 10) are actually discharged from the nozzles, and referring even to Table 1, the quantities of ink discharged from the nozzles can be different with respect to the same control value of "0". As described above, of course, after the control signal applied with respect to the control value is adjusted, not in the initial steps, the adjusted control signal is provided, while expecting that the same separated ink quantity is discharged from the nozzles. Even in this case, the same result as shown in FIG. 10 can be obtained.

The discharge performance indexes of the nozzles are divided as listed in Table 2. The discharge performance indexes are applied based on a difference between the separated ink quantity of 5.00 pl as desired to be discharged from the nozzles and the quantities of ink actually discharged from the nozzles. The separated ink quantity corresponds to an intermediate value in the range of the quantities of ink actually discharged from the nozzles.

In detail, a first nozzle group corresponding to the discharge performance index of "−7" includes the nozzles discharging the quantities of ink greater than 4.50 pl and less than 4.54 pl if they receive the control signal recognized as the control value of "0". According to the present invention, of course, the boundary values of the quantities of ink actually discharged from the nozzles, which provide the discharge performance indexes, may be determined in various ways.

The nozzles included in the first nozzle group have the lowest discharge performance than the normal nozzles, and so as to obtain the separated ink quantity of 5.00 pl, accordingly, the nozzles have to receive a large control signal corresponding to the control value of "+7". To do this, a matching relationship between the control signal and the control value has to be adjusted so as to identify the control value of "0" in the case where the first nozzle group receives the control signal corresponding to the control value of "+7". In detail, the biggest control signal recognizable by the nozzles has to be transferred to the first nozzle group, so that it can be expected that the quantity of ink of 5.00 pl is discharged from the first nozzle group.

A second nozzle group includes nozzles discharging the quantities of ink greater than 4.55 pl and less than 4.61 pl if they receive the control signal recognized as the control value of "0". The nozzles included in the second nozzle group have the discharge performance better than the first nozzle group, but the quantity of ink of 5.00 pl is not discharged therefrom. So as to obtain the result corresponding to the control value of "0", the control signal corresponding to the control value of "+6" has to be applied to the second nozzle group.

A third nozzle group includes nozzles discharging the quantities of ink greater than 4.62 pl and less than 4.68 pl if they receive the control signal recognized as the control value of "0". In the same manner as above, so as to obtain the ink discharge corresponding to the control value of "0", the control signal corresponding to the control value of "+5" has to be applied to the third nozzle group. If the control signals corresponding to the control values of the respective nozzle groups are managed in such ways, the results as listed in Table 3 can be obtained.

According to the present invention, the control signals are applied to allow the grayscale nozzles to distinguish their control level, while having discrete distribution. The control signals are indicated by integers proportional to their size, but they are not limited thereto.

TABLE 3

| Nozzle group | Range of quantity of ink discharged in case of receiving control signal corresponding to the control value of "0" | Control signal adjusted with respect to control value of "0" |
|---|---|---|
| First nozzle group | 4.50-4.54 | 7 |
| Second nozzle group | 4.55-4.61 | 6 |
| Third nozzle group | 4.62-4.68 | 5 |
| Fourth nozzle group | 4.69-4.75 | 4 |
| Fifth nozzle group | 4.76-4.82 | 3 |
| Sixth nozzle group | 4.83-4.89 | 2 |
| Seventh nozzle group | 4.90-4.96 | 1 |
| Eighth nozzle group | 4.97-5.03 | 0 |
| Ninth nozzle group | 5.04-5.10 | −1 |
| Tenth nozzle group | 5.11-5.17 | −2 |
| 11th nozzle group | 5.18-5.24 | −3 |
| 12th nozzle group | 5.25-5.31 | −4 |
| 13th nozzle group | 5.32-5.38 | −5 |
| 14th nozzle group | 5.39-5.45 | −6 |
| 15th nozzle group | 5.46-5.50 | −7 |

According to the present invention, as listed in Table 3, the quantities of ink actually discharged from the nozzles are divided equally to classify the plurality of nozzles into the plurality of nozzle groups. Otherwise, the plurality of nozzles may be classified into the plurality of nozzle groups based on the standard deviation of the quantities of ink actually discharged therefrom, and in consideration of the number of nozzles included in each nozzle group, the respective nozzle groups may have the same number of nozzles as each other.

As mentioned above, the control signals applied with respect to the control values to the classified nozzle groups are adjusted in the at step S1130.

In detail, the adjustment of the control signals is the same as of the control values for the nozzles. For example, different control signals are applied to the nozzles according to the discharge performance of the nozzles so as to recognize the same control value, and in terms of the control signals, however, the control values of the nozzles seem to be adjusted. So as to apply the control value of "0" to the ninth nozzle group, for example, the control signal lower by one step than the existing signal is applied, thereby applying the same control signal as the control value of "−1" before the adjustment. If the control signals are the same, the control value of "0" seems to be adjusted to the control value of "−1". For the convenience of the description, however, the inkjet printing method according to the present invention adjusts the control signals to be applied with respect to the same control value according to the discharge performance of the nozzles.

According to the present invention, the control signals (See Table 3) applied with respect to the control values mapped to the separated ink quantity of 5.00 pl to the respective nozzle groups are values inversely proportional to the discharge performance indexes determined with respect to the classified nozzle groups (See Table 2). Accordingly, the control signals applied with respect to the control values mapped to the separated ink quantity to the classified nozzle groups are determined based on a difference between the separated ink quantity as desired to be discharged and the quantities of ink actually discharged from the nozzles. As a result, if the discharge performance index of each nozzle is low with respect to the same separated ink quantity, the control signal is adjusted higher, and contrarily, if the discharge performance index is high, the control signal is adjusted lower.

As shown in Tables 1 and 3, the first, third to sixth, eighth, and ninth nozzles N1, N3, N4, N5, N6, N8 and N9 are included in the eighth nozzle group, and in case of the eighth nozzle group, there is no need to adjust the control signal with respect to the control value of "0" mapped to the separated ink quantity of 5.00 pl.

By the way, the second and seventh nozzles N2 and N7 are included in the ninth nozzle group, and in case of the ninth nozzle group, a substantially large quantity of ink is discharged with respect to the control value of "0" mapped to the separated ink quantity of 5.00 pl. Accordingly, the control signal is adjusted lower in such a manner as to correspond to the control value of "−1". The control signals applied with respect to the control values are adjusted as listed in Table 4. The adjustment of the control signals is not performed with respect to one control value, but performed with respect to the whole control value. That is, the relationships between the whole control value and the control signals are shifted.

TABLE 4

| | Control value | | |
|---|---|---|---|
| Nozzle No. | −1 | 0 | 1 |
| 1 | −1 | 0 | 1 |
| 2 | −2 | −1 | 0 |

TABLE 4-continued

| | Control value | | |
|---|---|---|---|
| Nozzle No. | −1 | 0 | 1 |
| 3 | −1 | 0 | 1 |
| 4 | −1 | 0 | 1 |
| 5 | −1 | 0 | 1 |
| 6 | −1 | 0 | 1 |
| 7 | −2 | −1 | 0 |
| 8 | −1 | 0 | 1 |
| 9 | −1 | 0 | 1 |

According to the adjustment of the control signals, the adjusted control signals with respect to the control values as listed in Table 1 are applied to the second nozzle and the seventh nozzle, and also, the separated ink quantities are adjusted as listed in Table 5.

TABLE 5

| | Control value | | |
|---|---|---|---|
| Nozzle No. | −1 | 0 | 1 |
| 1 | 4.90 | 4.97 | 5.04 |
| 2 | 4.92 | 4.99 | 5.06 |
| 3 | 4.91 | 4.98 | 5.05 |
| 4 | 4.95 | 5.02 | 5.09 |
| 5 | 4.93 | 5.00 | 5.07 |
| 6 | 4.95 | 5.02 | 5.09 |
| 7 | 4.91 | 4.98 | 5.05 |
| 8 | 4.92 | 4.98 | 5.03 |
| 9 | 4.94 | 5.01 | 5.08 |

According to the discharge relationships under the adjusted control signals, if the control values are determined, as shown in FIG. 4A, the quantities of ink discharged are updated as shown in FIG. 12B, which are different from those in FIG. 4B.

Referring to FIGS. 12A and 12B, it can be checked that the quantities of ink discharged on the second and seventh columns of the first row are lower by one step than those before the adjustment.

Accordingly, the control values of the second row are determined as shown in FIG. 13A. As the quantities of ink discharged on the second and seventh columns of the first row are low, the control values of the second and seventh columns of the first row are adjusted to "1", and the quantities of ink discharged are determined as shown in FIG. 13B.

After that, the control value for each dot is determined in the same manner as above with reference to FIGS. 6A to 8B, and a process for determining the control value for each dot at the positions of FIG. 3C and FIGS. 9A and 9B is shown in FIGS. 14A and 14B.

As shown in FIG. 14A, the sum of quantities of ink discharged on the dots except the fifth column of the third row in the window WD having the first to third rows and the third to fifth columns is 39.93 pl. Accordingly, a quantity of ink of 5.07 pl has to be desirably discharged to the dot of the fifth column of the third row, and in consideration of the discharge performance of the fifth nozzle N5, if the control value of "1" is applied, the sum of quantities of ink discharged in the window WD corresponds to the target print ink quantity, thereby achieving good print uniformity.

According to the present invention, the control signals applied with respect to the control values may be determined according to time during which a voltage having a value in advance set inputted to the nozzles is maintained. For example, if the time for maintaining the voltage having the value in advance set is extended, the sizes of the control signals may be increased.

Figure 15:
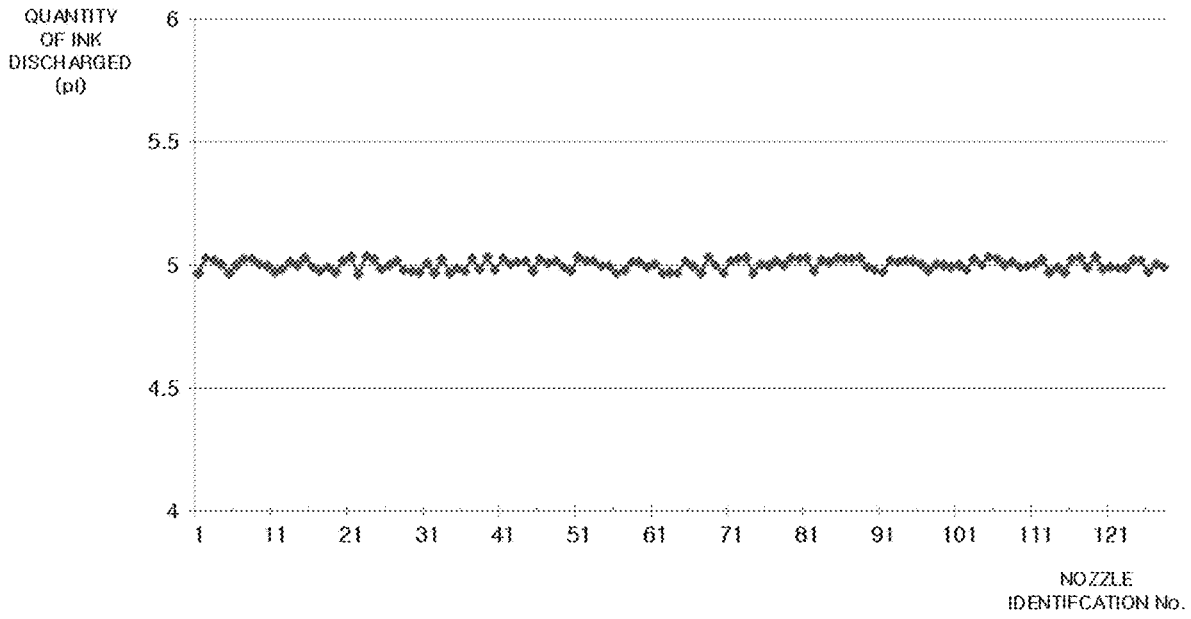
FIG. 15 is a graph showing the improvement in the quantities of ink discharged in case where the control signals are adjusted.

If the control signals are adjusted through the above-mentioned process, it can be checked, as shown in FIG. 15, that the quantities of ink discharged are improved. When compared with the graph of FIG. 10, the graph of FIG. 15 shows the reduction in deviations in the quantities of ink discharged from the nozzles.

According to the present invention, therefore, after the window WD has been set, the control values of the respective dots are determined to allow the target print ink quantity to be constantly maintained in the corresponding window WD, and on the other hand, the control signals applied with respect to the control values are adjusted according to the discharge performance of the nozzles. Further, as described above, the number of rows and columns, that is, the number of dots in the window WD may be different according to the resolution.

Figure 16A:
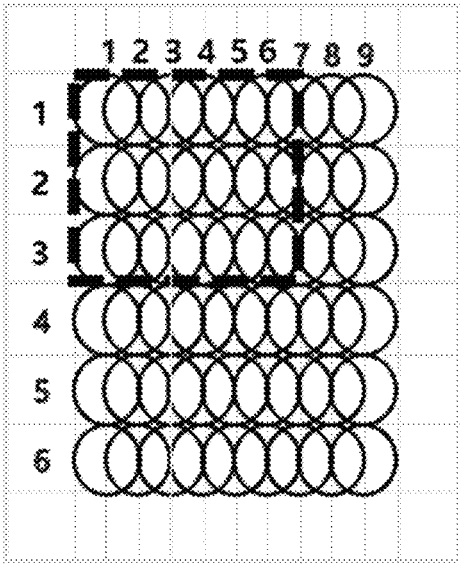
FIGS. 16A and 16B show relationships between the window and the dots included in the window according to various resolution.
Figure 16B:
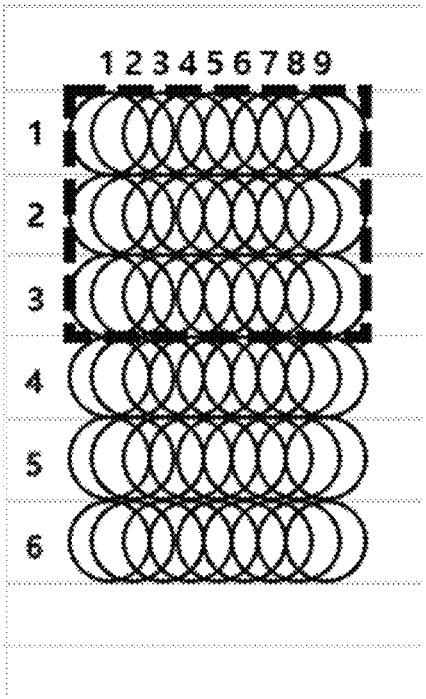

FIGS. 16A and 16B show relationships between the window and the dots included in the window according to various resolution.

FIG. 16A shows the number of dots in the window WD if the inkjet printing is performed with the resolution of 100×200 dpi, and FIG. 16B shows the number of dots in the window WD if the inkjet printing is performed with the resolution of 100×300 dpi.

As shown in FIGS. 16A and 16B, the number of dots in the window WD is increased in proportion to the resolution. As shown in FIG. 16A, 18 dots corresponding to three rows and six columns are included in the window WD, and if the reference separated ink quantity is 5.00 pl, accordingly, the target print ink quantity of the window WD is 90.00 pl made by multiplying 5.00 pl by 18. In the same manner as above, 27 dots corresponding to three rows and nine columns are included in the window WD, as shown in FIG. 16B, and if the reference separated ink quantity is 5.00 pl, accordingly, the target print ink quantity of the window WD is 135.00 pl made by multiplying 5.00 pl by 27.

In FIGS. 16A and 16B, of course, the control values of the outermost two rows in the window WD are first determined, and as the reference dot RD of the window WD moves by one row or one column, next, the control values of the dots in the window WD are determined.

Figure 17:
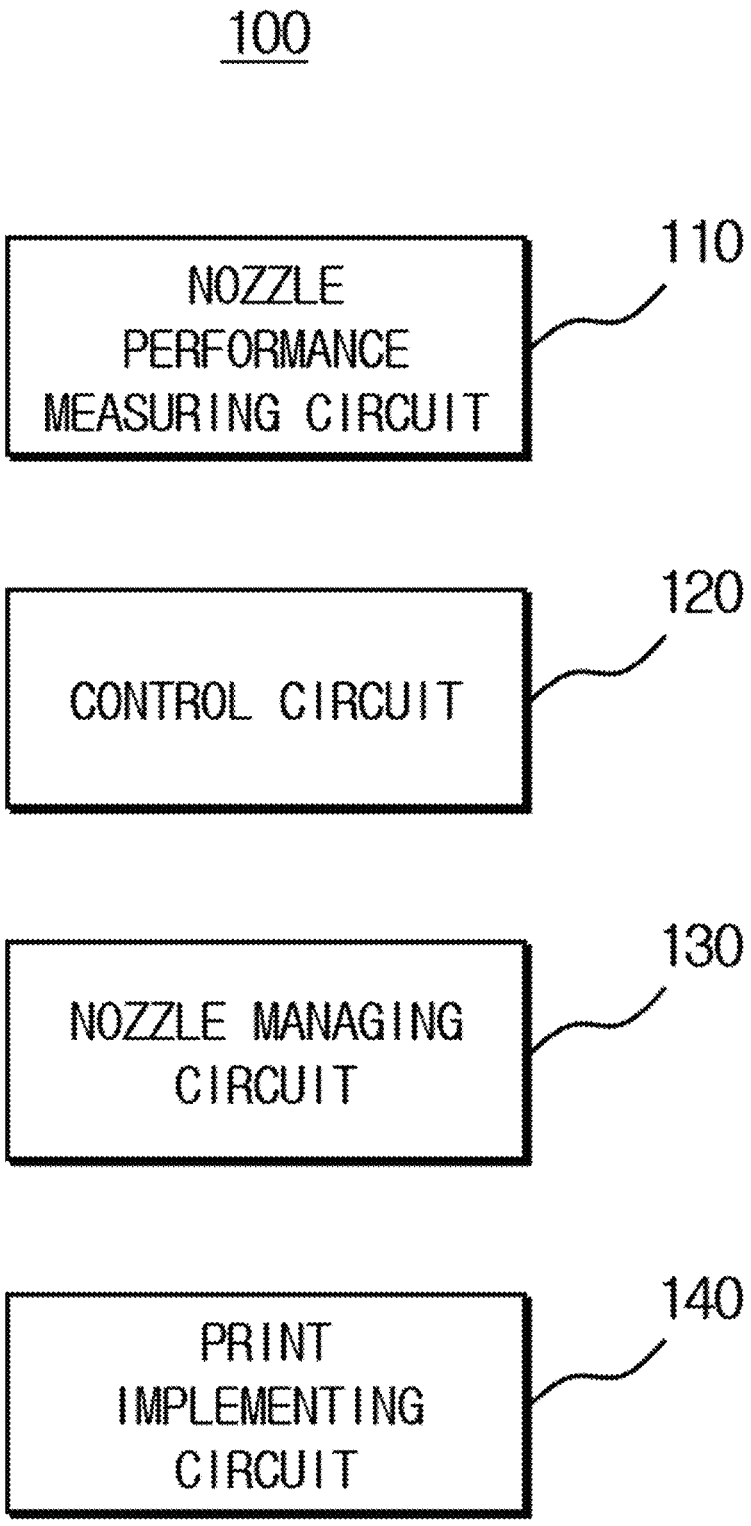
FIG. 17 is a block diagram showing an inkjet printing apparatus performing the inkjet printing method according to the present invention.

FIG. 17 is a block diagram showing an inkjet printing apparatus performing the inkjet printing method according to the present invention.

An inject printing apparatus according to the present invention includes the plurality of nozzles controlled with respect to the given control values mapped to the separated ink quantity in such a manner as to discharge the separated ink quantity mapped. According to the present invention, further, the control signals applied with respect to the control values can be adjusted according to the discharge performance of the nozzles. The plurality of nozzles is not shown in FIG. 17.

As shown in FIG. 17, the inkjet printing apparatus 100 according to the present invention includes a nozzle performance measuring circuit 110, a control circuit 120, a nozzle managing circuit 130, and a print implementing circuit 140.

The inkjet printing apparatus 100 can perform the inkjet printing method as mentioned above and is composed of a computer readable physical medium in which a program for performing the inkjet printing method is stored.

The nozzle performance measuring circuit 110 serves to input the control values mapped to the given separated ink quantity to the plurality of nozzles of the inkjet printing apparatus 100 to determine the discharge performance of the plurality of nozzles. The nozzle performance measuring circuit 110 is disposed in the inkjet printing apparatus 100, and otherwise, it receives data acquired from a device like a drop watcher to measure the discharge performance of the plurality of nozzles. The discharge performance of the nozzles measured by the nozzle performance measuring circuit 110 is managed under the nozzle managing circuit 130 and is thus utilized in the adjustment of the control signals with respect to the input of the control values for the window on which a plurality of discharge operations is performed.

In the window having a plurality of dots of at least two or more rows and columns determined based on print resolution, the control circuit 120 serves to calculate a target print ink quantity in case where reference separated ink quantities are discharged from the plurality of dots. So as to allow the sum of quantities of ink discharged of the ink dots in the window to be maintained to the calculated target print ink quantity, the control circuit 120 determines the control values of the plurality of nozzles based on the measured discharge performance of the plurality of nozzles.

While the window is moving by one row or column sequentially, for example, the control circuit 120 can determine the control values of the dots sequentially to allow the target print ink quantities to be maintained to the same quantity as each other. The operation of the control circuit 120 has been mentioned above, and therefore, a detailed explanation on the control circuit 120 will be avoided.

According to the present invention, the control circuit 120 may sense the case where the separated ink quantities mapped to the control values are different from the quantities of ink actually discharged by a value in advance set and above, according to the measured discharge performance of the nozzles. Otherwise, the control circuit 120 can sense that the discharge performance of the nozzles influences print uniformity in various ways.

In this case, the control circuit 120 allows the nozzle managing circuit 130 to adjust the control signals applied with respect to the control values to the nozzles. That is, if the quantity of ink discharged is excessively small even with respect to the same control value, the control signal is increased, and if the quantity of ink discharged is larger than the value in advance set, the control signal applied with respect to the same control value to the corresponding nozzle is decreased. The increment and decrement of the control signal are adjusted with discrete values, not with continuous values, like a way for adjusting grayscale levels.

The print implementing circuit 140 serves to perform the inkjet printing based on the control values. The print implementing circuit 140 performs the printing according to the control values determined to apply the target print ink quantity in the window over the whole printing area.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above teachings. It is therefore intended that the scope of the invention be limited not by this detailed description, but rather by the claims appended hereto. Terms used in this application are used to only describe given exemplary embodiments and are not intended to restrict the present invention. The steps may be differently carried out from the described order unless a given order is described. That is, the steps may be carried out in the same order as described, selectively, or individually. The present invention may be modified in various ways and may have several exemplary embodiments. Given exemplary embodiments of the present invention are illustrated in the drawings and described in detail in the detailed description. However, this does not limit the invention within given embodiments and it should be understood that the invention covers all the modifications, equivalents, and replacements within the idea and technical scope of the invention.

The invention claimed is:

1. An inkjet printing apparatus comprising:

a plurality of nozzles, each of the plurality of nozzles adapted to be controlled to discharge a separated ink quantity mapped to a control value, which is input thereto, a nozzle performance measuring circuit inputting the control value mapped to the separated ink quantity to the each of the plurality of nozzles, measuring quantities of ink discharged from the each of the plurality of nozzles, and determining a discharge performance of the plurality of nozzles; and a control circuit calculating a target print ink quantity in a case where a reference separated ink quantity is discharged from a plurality of dots on a window having the plurality of dots constituting at least two or more rows and columns determined based on a print resolution and determining the control value of each of the plurality of nozzles based on the discharge performance of the plurality of nozzles to allow the sum of quantities of ink discharged of ink dots injected into the window to be maintained to the target print ink quantity, wherein the control circuit designates one dot in the window as a reference dot and determines the control value of the each of the plurality of nozzles within the window as the reference dot and the window thereof move sequentially within a printing area.

2. The inkjet printing apparatus according to claim 1, wherein the control circuit determines a first control value of row or column located on the outermost position of the printing area as the first control value mapped to the reference separated ink quantity and determines a second control value of each of row or column adjacent to the row or column on the outermost position of the printing area through a comparison between the separated ink quantity and a quantity of ink actually measured.

3. The inkjet printing apparatus according to claim 2, further comprising a nozzle managing circuit adjusting control signals applied with respect to the control value to the each of the plurality of nozzles if a difference between the separated ink quantity mapped to the control value and the quantity of ink actually discharged is greater than a pre-determined value.

4. The inkjet printing apparatus according to claim 3, wherein the plurality of nozzles are classified into a plurality of nozzle groups based on their discharge performance.

5. The inkjet printing apparatus according to claim 2, wherein the control circuit predetermines the first control value for the row or column on the outermost position of the printing area except a last row or column on the outermost position of the printing area.

6. The inkjet printing apparatus according to claim 1, wherein the window sequentially moves from a first position to a second position, and wherein the window at the first position and the window at the second position have overlapped area.

* * * * *